US005547391A

United States Patent [19]

Benes et al.

[11] Patent Number: 5,547,391

[45] Date of Patent: Aug. 20, 1996

[54] COMMONING ELECTRICAL CONNECTOR

[75] Inventors: Kevin C. Benes, Willowbrook; Jeffrey J. Pawlicki, Downers Grove, both of Ill.

[73] Assignee: Molex Incorporated, Lisle, Ill.

[21] Appl. No.: 29,862

[22] Filed: Mar. 11, 1993

[51] Int. Cl.[6] ..... H01R 4/24

[52] U.S. Cl. ..... 439/399; 439/452

[58] Field of Search ..... 439/389–425, 439/452

[56] References Cited

U.S. PATENT DOCUMENTS

| | | | |
|---|---|---|---|
| 3,012,219 | 12/1961 | Levin et al. | 439/402 |
| 3,489,985 | 1/1970 | Martin | 439/516 |
| 3,836,942 | 9/1974 | Knickerbocker | 439/402 |
| 4,379,605 | 4/1983 | Hoffman | 439/516 |
| 4,653,831 | 3/1987 | Wilson et al. | 439/404 |
| 5,037,308 | 8/1991 | Bryce et al. | 439/516 |

*Primary Examiner*—David L. Pirlot
*Attorney, Agent, or Firm*—A. A. Tirva

[57] ABSTRACT

An electrical connector is provided for commonly connecting a plurality of conductors, such as insulated conductor wires. An insulating housing has a wire-receiving face, a base and generally parallel side walls extending between the base and the face, defining an elongated cavity therewithin. A strip of terminal devices is assembled in the elongated cavity. Each terminal device includes at least one insulation-displacement wire-terminating slot for reception of an insulated conductor wire. Wire-admitting slots are provided in each housing side wall aligned with the wire-terminating slots in the terminal devices. Each wire-admitting slot includes a first, wire-restraining section for temporarily holding an insulated conductor wire prior to insertion into the respective wire-terminating slot, and a second, wire-securing section for finally holding the insulated conductor wire when inserted into the wire-terminating slot. The terminal devices are joined in the strip by web portions structured to be readily broken to facilitate severing the strip of terminal devices at any location between any two adjacent devices. The housing includes access apertures through which the web portions can be broken from outside the housing.

6 Claims, 3 Drawing Sheets

COMMONING ELECTRICAL CONNECTOR

FIELD OF THE INVENTION

This invention generally relates to the art of electrical connectors and, particularly, to an electrical connector for commonly connecting a plurality of conductors or wires.

BACKGROUND OF THE INVENTION

Electrical connector apparatus have been provided for commonly connecting a plurality of conductors. An early commoning connector device included an insulating support on which at least one metallic junction bar or terminal strip was mounted. Clamping devices or screws were used to clamp the ends of the conductors to the junction bar to thereby interconnect the conductors to one another. In the case of insulated conductor wires, the ends of the wires were stripped to expose the conductor ends for clamping. Crimping-type terminals also have been used on such junction bars or strips to common the conductors.

From such early commoning connectors, improvements have been made, such as providing the connectors with insulation-displacement terminals so that the insulated conductor wires do not have to be prepared by stripping the insulation therefrom. An example of such a commoning connector is shown in U.S. Pat. No. 4,227,763 to Marks, dated Oct. 14, 1980.

This invention is directed to providing a commoning connector of the character described which includes further improvements, such as features for preliminarily or temporarily holding the wires prior to termination, and for severing a junction bar or terminal strip to a desired length from a continuous terminal strip.

SUMMARY OF THE INVENTION

An object, therefore, of the invention is to provide a new and improved electrical connector for commonly connecting a plurality of conductors such as insulated conductor wires.

In the exemplary embodiment of the invention, the connector includes an insulating housing having generally parallel side walls extending between a wire-receiving face and a base or bottom wall, thereby defining an elongated terminal strip-receiving cavity therewithin. A strip of terminal devices is mounted in the elongated cavity. Each terminal device includes at least one insulation-displacement wire-terminating slot for reception of an insulated conductor wire. Wire-admitting slots are provided in each side wall of the housing, with the wire-admitting slots being aligned with the wire-terminating slots of the terminal devices.

The invention contemplates that each wire-admitting slot in the side walls of the housing include a first, wire-restraining section for temporarily holding an insulated conductor wire prior to insertion into the respective wire-terminating slot of its terminal device. A second, wire-securing section is provided for finally holding the insulated conductor wire after it has been inserted into the wire-terminating slot.

As disclosed herein, each terminal device includes a pair of plate portions generally parallel to the side walls of the housing. Each plate portion has one of the insulation-displacement wire-terminating slots therein. Each terminal device is generally U-shaped with a pair of legs integrally joined by a bight portion, the legs defining the plate portions of the terminal device. The terminal devices are integrally joined at their bight portions by web portions to define the elongated strip of terminal devices.

According to another aspect of the invention, the web portions of the strip between the terminal devices are relatively narrow or structured to be readily broken and thereby facilitate severing the strip at any location between any two adjacent terminal devices. Generally, access means are provided in the housing and through which the web portions can be broken from outside the housing. Specifically, apertures are provided in the base or bottom wall of the housing at locations aligned with the web portions of the strip when the strip is located in the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
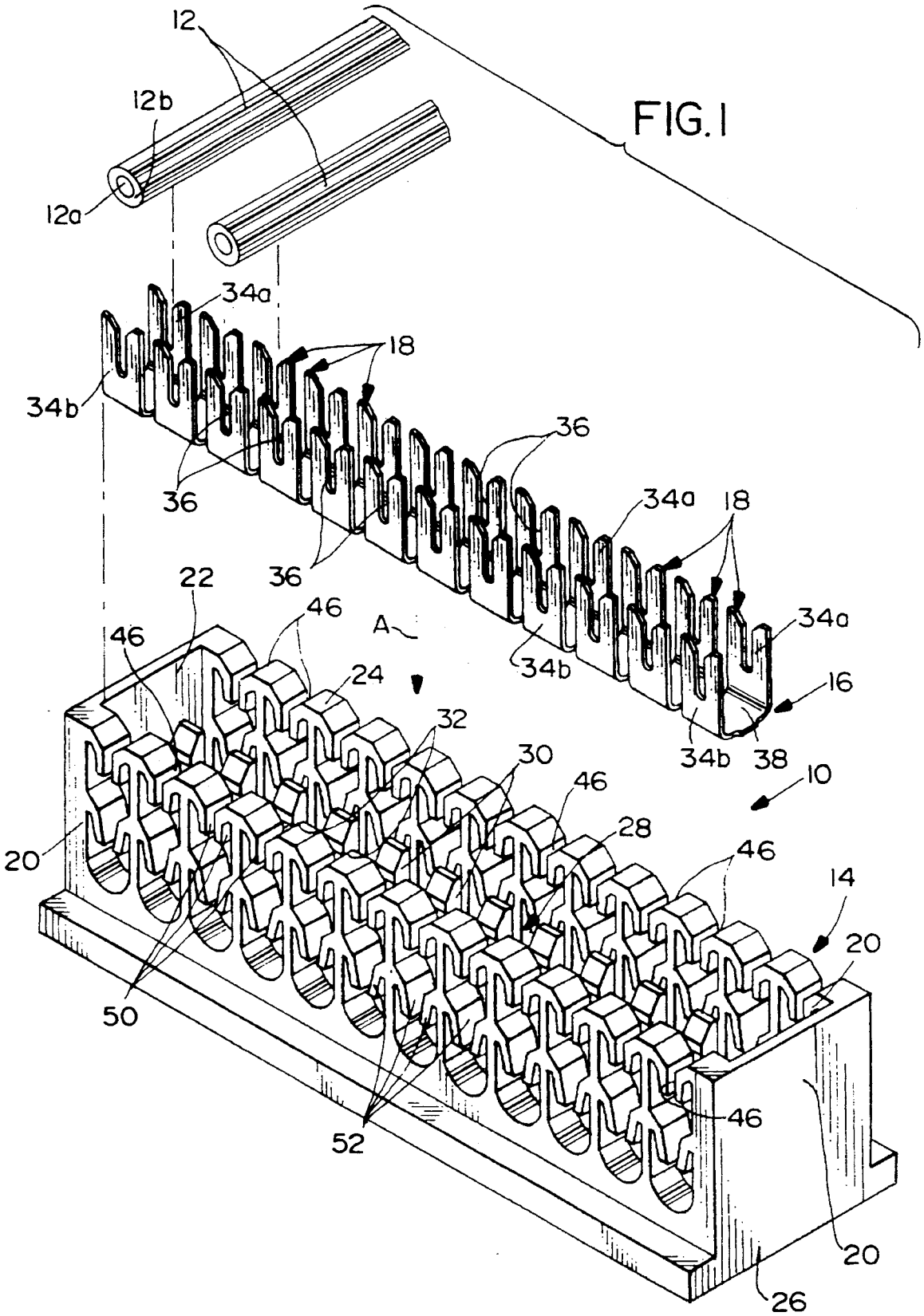
FIG. 1 is an exploded perspective view of a commoning electrical connector embodying the concepts of the invention.

Referring to the drawings in greater detail, and first to FIG. 1, the invention is embodied in an electrical connector, generally designated 10, for commonly connecting a plurality of insulated conductor wires 12 each having a conductor core 12*a* surrounded by an insulating covering or outer sheath 12*b*. Generally, connector 10 includes an insulating housing, generally designated 14, for mounting a strip, generally designated 16, of terminal devices, generally designated 18.

Figure 2:
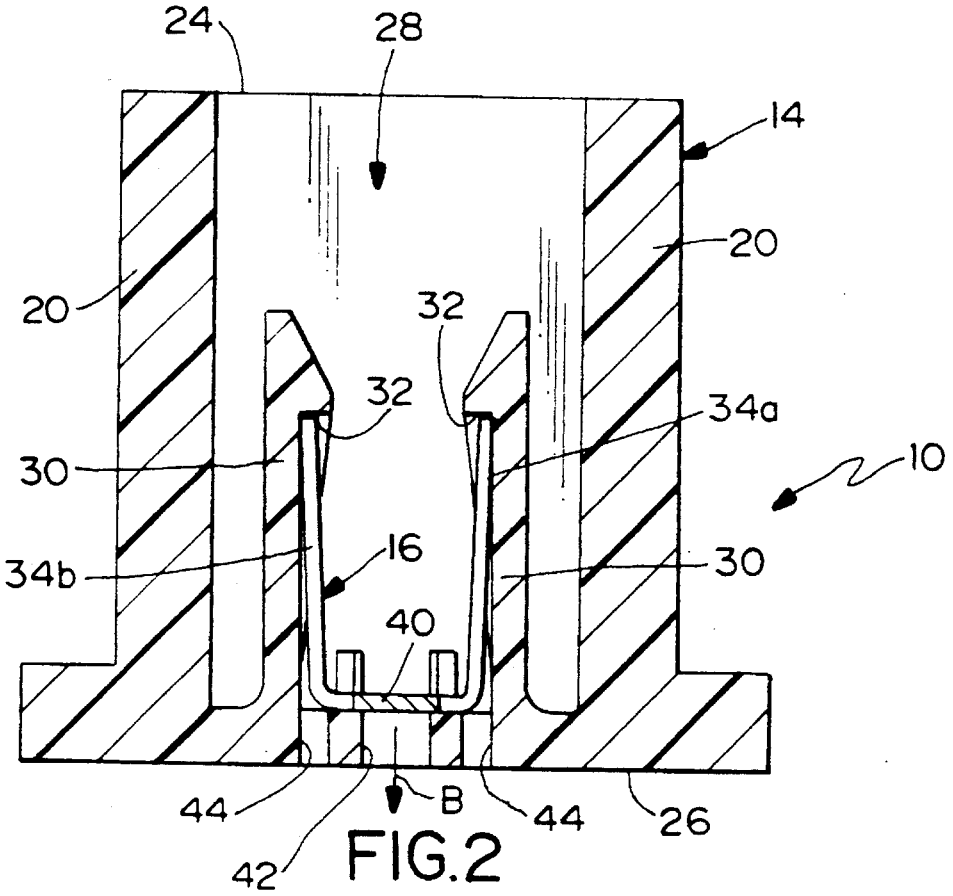
FIG. 2 is a transverse vertical section through the connector in assembled condition, taken at a point between a pair of adjacent terminal devices.
Figure 3:
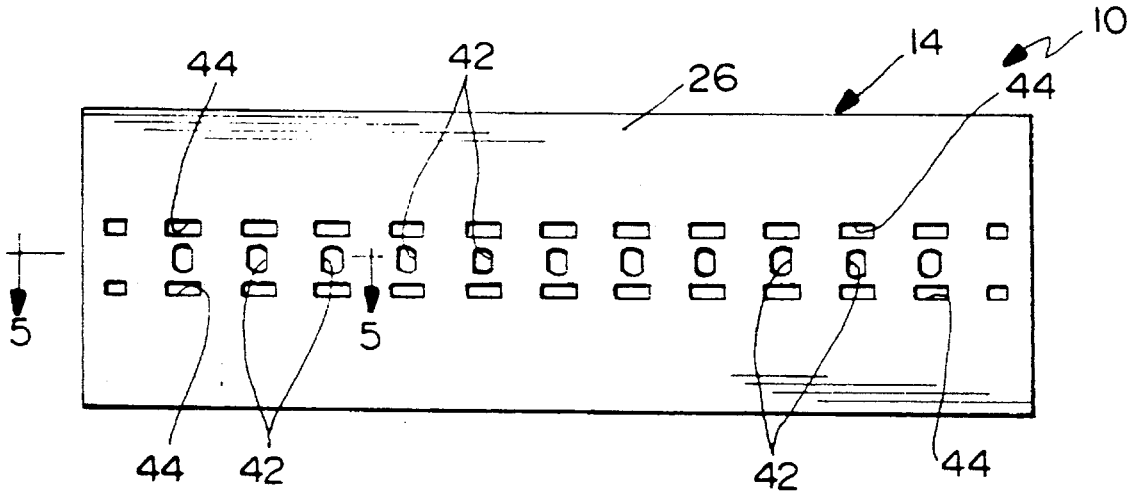
FIG. 3 is a bottom plan view of the housing of the connector.

Referring to FIGS. 2 and 3 in conjunction with FIG. 1, insulating housing 14 has a pair of generally parallel side walls 20 and a pair of end walls 22 extending between a wire-receiving face 24 and a base or bottom wall 26, all of which combine to define an elongated terminal strip receiving cavity 28 therewithin. A plurality of opposing pairs of cantilevered spring latch arms 30 project upwardly from base 26 within cavity 28. The latch arms have inwardly directed hook portions 32 for latchingly engaging the upper edges of strip 16 of terminal devices 18, as best seen in FIG. 2. The entire insulating housing may be unitarily molded of plastic or like material.

Figure 4:
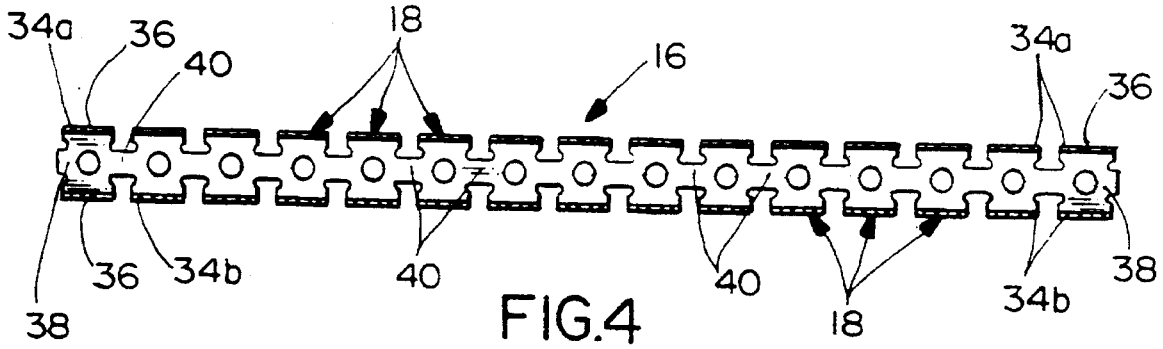
FIG. 4 is a top plan view of the strip of terminal devices of the connector.

Referring to FIG. 4 in conjunction with FIG. 1, strip 16 of terminal devices 18 is assembled into cavity 28 of housing 14 in the direction of arrow "A" in FIG. 1. Each terminal device 18 includes a pair of plate portions 34*a* and 34*b* which extend generally parallel to side walls 20 of housing 14. Each plate portion has an insulation-displacement wire-terminating slot 36, the slots opening toward wire-receiving face 24 of housing 14. As seen best by the right-hand terminal device 18 of strip 16 in FIG. 1, each terminal device is generally U-shaped with a pair of legs defining plate portions 34*a* and 34*b*, the legs being integrally joined by bight portions 38. The entire strip of terminal devices may be stamped and formed from sheet metal material. As best seen in FIG. 4, the bight portions of the generally U-shaped terminal devices 18 are joined lengthwise of strip 16 by integral web portions 40 which are considerably narrower than the strip itself, i.e. considerably narrower than bight portions 38. Therefore, with the strip of terminal devices being fabricated of thin sheet metal material, web portions 40 are readily frangible or severable to facilitate severing the strip at any location between any two adjacent terminal devices.

According to the concepts of the invention, commoning connector 10 is designated so that strip 16 of terminal devices 18 can be severed at points along its length from outside housing 14 after the strip is mounted within the housing. Generally, access means are provided in the housing and through which web portions 40 (FIG. 4) can be broken from outside the housing.

More particularly, referring to FIGS. 2 and 3, it can be seen that a plurality of apertures 42 are provided through the base or bottom wall 26 of housing 14 at locations so that the apertures are aligned with web portions 40 when the strip of terminal devices is mounted within cavity 28 of the housing, as best seen in FIG. 2. Therefore, a tool can be inserted into one or more of the apertures 42, in the direction of arrow "B" (FIG. 2), and sever or punch through one or more of web portions 40 without removing the strip of terminal devices from the housing or without effecting such severances before assembling the strip into the housing, the latter resulting in additional assembly processes for multiple strip sections. Holes 44 outside apertures 42 simply are provided in bottom wall 26 for insertion therethrough of appropriate core pins to form hook portions 32 of latch arms 30 during a molding process of housing 14.

After strip 16 of terminal devices 18 is assembled within cavity 28 of housing 14, insulated conductor wires 12 can be inserted individually into a plurality of wire-admitting slots 46 (FIGS. 1 and 5) in side walls 20 of the housing. The wire-admitting slots are aligned with wire-terminating slots 36 in terminal devices 18.

Figure 5:
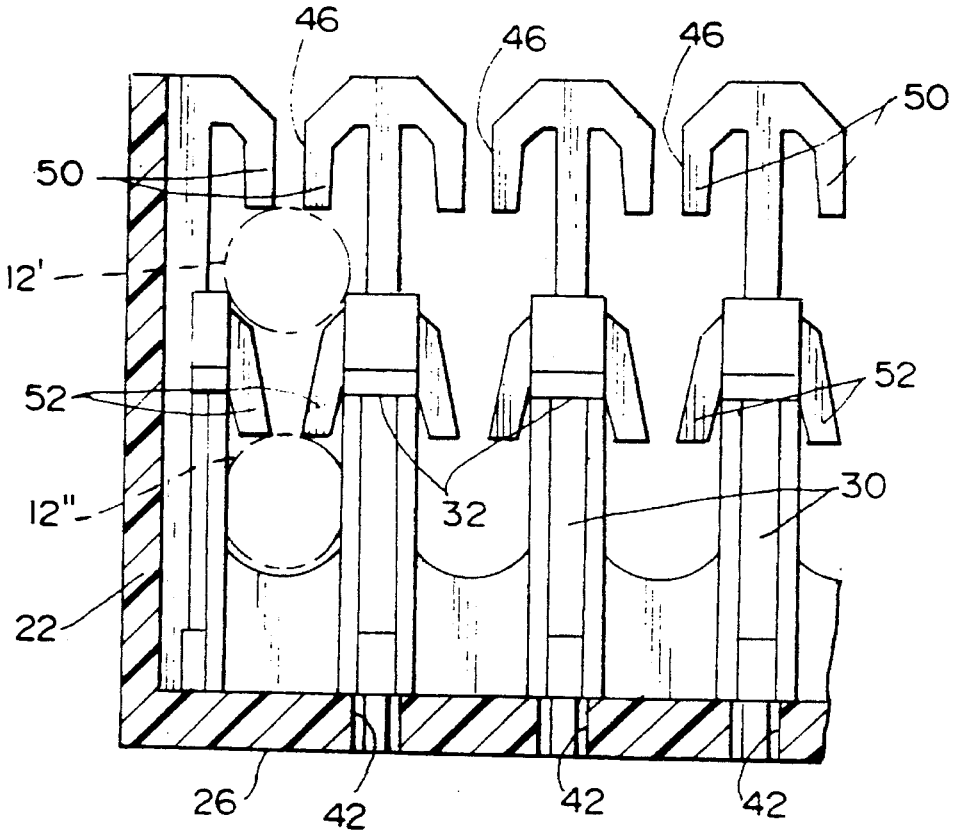
FIG. 5 is a vertical section, on an enlarged scale, taken generally along line 5—5 of FIG. 3.

According to another aspect of the invention, generally, housing 14 is provided with means within wire-admitting slots 46 for temporarily holding conductor wires 12 in the slots prior to insertion of the wires into the terminal devices, and also to provide means for finally holding the conductor wires after they are inserted into the respective terminal devices. More particularly, as best seen in FIG. 5 in conjunction with FIG. 1, a plurality of first resilient fingers 50 project into slots 46 at points above terminal devices 18 of strip 16. These first fingers define wire-restraining sections for temporarily holding conductor wires 12 prior to insertion into their respective wire-terminating slots in terminal devices 18. This temporary or preliminary location of a conductor wire is indicated in phantom at 12' in FIG. 5.

A plurality of second resilient fingers 52 project into slots 46 at locations below fingers 50, to define wire-securing sections for finally holding the insulated conductor wires after they are inserted into their wire-terminating slots 36 in terminal devices 18. This location of a conductor wire is shown in phantom at 12" in FIG. 5. With housing 14 being unitarily molded of plastic material, fingers 50 and 52 are resilient so that the conductor wires can be forced past the fingers to the temporary and final positions, as the fingers snap back to their positions shown in FIG. 5 to hold the conductor wires in either of their temporary or final positions. By providing temporary restraint for the conductor wires prior to termination into the terminal devices, an operator can individually assemble a plurality of wires to housing 14, and then all of the wires can be mass terminated into their respective terminal devices thereafter.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for commonly connecting a plurality of insulated conductor wires, comprising:

an insulating housing having generally parallel side walls defining an elongated terminal strip-receiving cavity therebetween, a strip of terminal devices in the elongated cavity of the housing, each terminal device including at least one insulation-displacement wire-terminating slot for reception of an insulated conductor wire, and wire-admitting slots in each of said side walls, the wire-admitting slots being aligned with the wire-terminating slots in the terminal devices, each wire-admitting slot including a first, wire-restraining section for temporarily holding an insulated conductor wire prior to insertion into the respective wire-terminating slot and a second, wire-securing section for finally holding the insulated conductor wire when inserted into the wire-terminating slot.

2. The electrical connector of claim 1 wherein each of said terminal devices is generally U-shaped with a pair of legs integrally joined by a bight portion, the legs defining a pair of plate portions parallel to said sidewalls said terminal devices are integrally joined at their bight portions by web portions to define said strip of terminal devices; and said web portions are structured to be readily broken to facilitate severing the strip of terminal devices at any location between any two adjacent terminal devices.

3. The electrical connector of claim 2, including access means in said housing and through which said web portions can be broken from outside the housing.

4. The electrical connector of claim 3 wherein said housing includes a wire-receiving face with which said cavity, said wire-terminating slots and said wire-admitting slots communicate, and a bottom wall spanning said side walls, said access means comprising apertures in the bottom wall.

5. An electrical connector for commonly connecting a plurality of insulated conductors, comprising an insulating housing having a wire-receiving face, a base and generally parallel sidewalls extending between the face and the base and defining an elongated cavity therebetween, a substantially "U" shaped strip of terminal devices in the elongated cavity, the strip being severable between adjacent terminal devices, means for releasably locking said strip of terminal devices within said elongated cavity, and wire-admitting slots in each of said side walls, the wire-admitting slots being aligned with the wire-terminating slots in the terminal devices, each wire-admitting slot including a first, wire-restraining section for temporarily holding an insulated conductor wire prior to insertion into the respective wire-terminating slot and a second, wire-securing section for finally holding the insulated conductor wire when inserted into the wire-terminating slot.

6. The electrical connector of claim 5, wherein said locking means includes at least one pair of resilient latches projecting from the base of the cavity, each projection having a surface for releasably engaging a different upper edge of the "U" shaped strip terminal.

* * * * *